United States Patent [19]

Ramachandran et al.

[11] Patent Number: 4,873,001

[45] Date of Patent: Oct. 10, 1989

[54] FABRIC SOFTENING AND ANTISTATIC LIQUID DETERGENT COMPOSITIONS

[75] Inventors: Pallassana N. Ramachandran, Robbinsville; Paul S. Grand, Highland Park; Robert A. Bauman, New Brunswick, all of N.J.

[73] Assignee: Colgate-Palmolive Company, New York, N.Y.

[21] Appl. No.: 207,843

[22] Filed: Jun. 17, 1988

Related U.S. Application Data

[63] Continuation of Ser. No. 53,979, May 22, 1987.

[51] Int. Cl.[4] ..... C11D 3/32

[52] U.S. Cl. ..... 252/8.8; 252/8.6; 252/140; 252/155; 252/174.25

[58] Field of Search ..... 252/8.6, 8.8, 140, 155, 252/174.25

[56] References Cited

U.S. PATENT DOCUMENTS

| | | | |
|---|---|---|---|
| 3,936,537 | 2/1976 | Baskerville, Jr. | 428/279 |
| 3,993,573 | 11/1976 | Gloss | 252/89.1 |
| 4,308,151 | 12/1981 | Cambre | 252/8.8 |
| 4,418,011 | 11/1983 | Bauman et al. | 252/8.8 |
| 4,497,715 | 2/1985 | Bauman | 252/174.25 |

*Primary Examiner*—Paul Lieberman
*Assistant Examiner*—Willie J. Thompson
*Attorney, Agent, or Firm*—N. Blumenkopf; R. C. Sullivan; M. M. Grill

[57] ABSTRACT

A fabric softening and antistatic liquid laundry detergent composition includes synthetic anionic organic detergent, bentonite and higher aliphatic isostearamide antistat in an aqueous medium. The liquid detergent composition preferably contains a builder for the detergent component, such as polyphosphate and/or carbonate. Also within the invention is a process for washing and drying laundry, utilizing the described liquid detergent in the washing operation, whcih produces laundry that is soft and static-free or of low electrostatic charge despite having been subjected to a tumble drying process or similar static charging drying process, which normally causes laundry of similar fabrics to become electrostatically charged, resulting in objectionable "static cling". Also described is a "softstat" product which comprises bentonite fabric softener and N-isostearamide antistat in an aqueous medium, which is intended for addition to liquid detergent compositions or to wash waters to make them fabric softening and antistatic, so that laundry washed with them will be soft to the touch and free of static cling.

12 Claims, No Drawings

FABRIC SOFTENING AND ANTISTATIC LIQUID DETERGENT COMPOSITIONS

This is a continuation of application Ser. No. 053,979, filed 5/22/87.

This application is for a liquid detergent which incorporates an antistatic agent or agents described in U.S. patent application Ser. No. 674,194, filed Nov. 23, 1984 and issued Jan. 7, 1986 as U.S. Pat. No. 4,563,288, which application is a continuation-in-part of Ser. No. 404,794 of Robert A. Bauman (one of the present coinventors) Aug. 3, 1982, and issued as U.S. Pat. No. 4,497,715, on Feb. 5, 1985.

The present invention relates to detergent compositions. More particularly, it relates to fabric softening and antistatic liquid detergent compositions, preferably built detergent compositions, which include synthetic organic detergent, builder (preferably) for the detergent, bentonite and N-higher aliphatic isostearamide antistat, in an aqueous medium. Also within the invention is a process for washing and drying laundry which produces laundry that is soft and static-free or of low electrostatic charge despite having been subjected to a normal tumble drying operation.

Built synthetic organic detergent compositions are today the cleaning materials of choice for washing dirty laundry. Such compositions have been found to be exceptionally effective in laundering fabric items made from synthetic and/or natural fibrous materials, whether such have been stained with oily, protein or clay soils, which three soils are those most frequently encountered in home laundering, and which are fairly representative of soils normally occurring and present on usual dirty laundry. With the replacement of soap in washing compositions by synthetic organic detergents the softening effect of the soap (usually as an insoluble soap which deposited on the laundry fabric fibers) has been lost and especially in the presence of certain inorganic builder salts the laundry will often become unpleasant to the touch, rough and stiff (or boardy). For years it has been known that bentonite, when added to synthetic organic detergent compositions based on anionic detergents, could help to soften the laundry and thereby could make detergent compositions that were so modified acceptable to the consumer.

While liquid detergent compositions have been known for years it was only comparatively recently that liquid state heavy duty built laundry detergent compositions became very popular. Such formulations, especially when they contain suspended solids, are sometimes thickened to prevent settling out of components, on storage. Bentonite, of the gelling type, such as western or Wyoming bentonite, has thickening properties and additionally, is a fabric softener With the advent of synthetic polymeric fibers and clothing and other laundry items made from them and from blends of such synthetics with natural fibers, such as cotton/polyester blends, and with the increasing use of automatic laundry dryers, which are almost all of the tumble drying type, it was found that dried laundry often accumulated electrostatic charges that would cause it annoyingly to cling together, interfering with normal handling and with folding of the laundry for storage. Cationic compounds, such as quaternary ammonium salts, e.g., di-higher alkyl di-lower alkyl ammonium halides, have been known for years to be capable of acting as antistatic agents (antistats) to decrease static charges on fabric items and to prevent static cling. In softening laundry such halides would normally be added in the rinse water during a washing cycle, and not in a detergent composition or in the wash water, because they react chemically with anionic detergents, which are the detergents most frequently employed in synthetic organic detergent compositions. Such reaction, which would be expected to be more severe in liquid detergents than in particulate products, would diminish the detersive power of the detergent composition and could create undesirable reaction products, which could deposit on the laundry being washed, creating dirty or greasy spotting In recent years cationic compounds, such as the quaternary ammonium halides, have been formulated into built detergent compositions, especially particulate detergent compositions, in which they do not chemically react objectionably with the anionic detergents during storage but do react to some extent with them in the wash water. While such compositions exert an antistatic effect and diminish static cling of the washed laundry it has been noted that the detergency of the compositions in which they are present is inferior to that of the base composition without the antistat.

In U.S. Pat. Nos. 4,497,715 and 4,563,288 Robert A. Bauman, the present inventor, described the use of N-primary alkyl isostearamides as antistatic agents in detergent compositions, and reported that such isostearamides did not react objectionably with anionic detergents in the compositions or in the wash water. In such patents Mr. Bauman reported that the described isostearamides could be combined with bentonite and employed with particulate detergent compositions and would produce a wash water possessing both fabric softening and antistatic properties, so that laundry washed with it would be soft and free of objectionable static cling. The present application describes in detail liquid detergent compositions containing both bentonite and N-substituted isostearamide antistat, and describes the desirable effects obtained from them, which include washed laundry of satisfactory softness (especially towels made from fabrics woven or otherwise manufactured from natural organic vegetable fibers, such as cottons and terrycloths), washed laundry of little or no static cling, improved detergency, and no "quat spots" on washed laundry. Especially noteworthy is the unexpected improvement in the antistatic effect of the N-primary aliphatic isostearamide due to the presence of the bentonite in the liquid built detergent composition (in the presence of anionic detergent). Additionally, no reductions in foaming power and no reductions in fluorescent brightening effects are noted when using the present anionic detergent compositions containing bentonite and CISA, whereas when quaternary ammonium salts are employed as antistats, foaming capabilities are diminished, apparently due to the reaction of the quaternary salt with the anionic detergent. Furthermore, yellowing or similar discoloration of the laundry by an antistat, and soil redeposition are diminished, compared to those resulting when a quaternary ammonium halide is utilized with an anionic detergent in other built detergent compositions for any antistatic properties it can contribute.

In accordance with the present invention a particulate fabric softening and antistatic liquid detergent composition comprises a detersive proportion of a synthetic organic detergent, a fabric softening proportion of bentonite and an antistatic proportion of higher aliphatic isostearamide antistat, in an aqueous medium. Normally, the active detergent component of the described detergent composition will be an anionic detergent (which would be reactive with a quaternary ammonium salt), and the detergent composition will be a built composition, containing a detergent builder, such as sodium tripolyphosphate, sodium carbonate, NTA, or polyacetal carboxylate or other suitable builder, or mixture of such builders. In a preferred liquid detergent composition the isostearamide will be dissolved, emulsified or dispersed and the bentonite will be present as a finely divided dispersion, with the particles thereof preferably being smaller than No. 200, U.S. Sieve Series, such as of No's. 200 to 400 sieves, e.g., about No. 325 sieve. If desired, the bentonite and/or N-isostearamide may be added to the wash water before, after or together with the balance of components of the described liquid detergent composition.

The anionic synthetic organic detergent of the present detergent compositions will normally be sulfated and/or sulfonated lipophilic material(s) having an alkyl chain of 8 to 20 carbon atoms, preferably 10 to 18 and more preferably 12 to 16, and preferably will be a particular mixture of two types of such detergents. While various water soluble salt-forming cations may be used to form the desired soluble sulfated and sulfonated detergents, including ammonium and lower alkanolamine (such as triethanolamine), and magnesium, usually an alkali metal, such as sodium or potassium, is employed, and very preferably such cation will be sodium. Among the various anionic detergents that are useful in the practice of this invention the linear higher alkylbenzene sulfonates with 10 to 18 carbon atoms making up the alkyl chain, preferably 12 to 16 and more preferably about 12 to 14, e.g., dodecyl and tridecyl, are considered most suitable, often with a salt of a sulfuric acid of a polyethoxylated higher fatty alcohol. The alcohol ether sulfate will normally be of a higher linear (such as fatty) alcohol of 10 to 18, preferably 12 to 15 carbon atoms, and the extent of ethoxylation will usually be 1 to 15 ethoxy groups per mole, preferably 2 to 10, more preferably 2 to 5, e.g., 3. Also, useful, among other synthetic detergents, are the monoglyceride sulfates, higher fatty alcohol sulfates, paraffin sulfonates and olefin sulfonates, in all of which compounds the alkyl group present is usually of 10 to 18 carbon atoms. Some such alkyl groups may be slightly branched (not preferred) but will still be of a carbon chain length within the described range.

Although the linear higher alkylbenzene sulfonates and the sulfated polyethoxylated higher alcohols, as the sodium salts, are the preferred anionic detergents utilized in the practice of the present invention, mixtures of such detergents with other such sulfonates and sulfates containing different cations may be employed, as may be mixtures of such detergents with others, such as the fatty alcohol sulfates. In some instances only relatively minor or diminished proportions of the linear alkylbenzene sulfonates and polyethoxylate sulfates will be present or the anionic synthetic organic detergent may be a mixture of other anionic detergents of the types described. Also, various other anionic detergents may be employed, such as those which are well known in the art, which are described in various annual publications entitled *McCutcheon's Detergents and Emulsifiers,* for example, that which was issued in 1969.

While the present invention is primarily of anionic detergent compositions which have antistatic properties, the desirable results mentioned herein are also obtainable with compositions containing other types of synthetic organic detergents, often with the anionic detergents, such as nonionic and amphoteric detergents. The mentioned nonionic and amphoteric materials are normally present in only minor proportions, if present at all, and usually only half as much thereof will be present, at the most, as of the synthetic anionic organic detergent. Preferred nonionic detergents are the ethylene oxide condensation products of higher fatty alcohols, such as condensation products of higher fatty alcohols of 12 to 18 carbon atoms with from 3 to 20 moles of ethylene oxide, preferably condensation products of higher fatty alcohols of 12 to 15 carbon atoms with 5 to 15 moles of ethylene oxide.

The detergent will preferably be built with a detergent builder so that it will have increased cleaning power and be suitable for "heavy duty" cleaning applications. Among useful builders for the present compositions are the polyphosphates such as sodium tripolyphosphate and tetrasodium pyrophosphate, sodium carbonate, sodium bicarbonate, sodium sesquicarbonate, sodium silicate ($Na_2O:SiO_2 = 1.6$ to 3.0, preferably 1:2.4, NTA, sodium citrate, sodium gluconate, borax, other borates, zeolites, polyacetal carboxylates and other useful builders known in the liquid detergent art. Often sodium silicates will be omitted because in liquid media they may react objectionably with carbonate and zeolite builders, and with bentonite, to produce undesirably thick or coagulated products or precipitates.

When zeolite builders are employed they will usually be of the formula $(Na_2O)_x.(Al_2O_3)_y.(SiO_2).w\ H_2O$, wherein x is 1, y is from 0.8 to 1.2, preferably about 1, z is from 1.5 to 3.5, preferably 2 to 3 or about 2, and w is from 0 to 9, preferably 2.5 to 6. Such zeolites are cation exchanging and have an exchange capacity for calcium ion in the range of about 200 to 400 or more milligram equivalents of calcium carbonate hardness per gram. They will very often be hydrated to the extent of 5 to 30%, preferably 10 to 25% moisture, e.g., about 20% thereof. Zeolite A is preferred (X and Y are also useful) and for such zeolite, Type 4A is most preferred. Particle sizes of the zeolite(s) will usually be 100 to 400 mesh (or sieve number), preferably 140 or 200 to 325 mesh, but their ultimate sizes will be submicron. The various zeolites are described at length in the text *Zeolite Molecular Sieves,* by Donald W. Breck, published in 1974 by John Wiley & Sons, especially at pages 747–749 thereof.

When polyacetal carboxylates are present they may be considered to be those described in U.S. Pat. No. 4,144,226 and may be made by the method mentioned therein. A typical such product will be of the formula $$R_1-\underset{\underset{COOM}{|}}{(CHO)_n}-R_2$$

wherein M is selected from the group consisting of alkali metal, ammonium, alkyl groups of 1 to 4 carbon atoms, tetra-alkylammonium groups and alkanolamine groups, which are of 1 to 4 carbon atoms in the alkyls thereof, n averages at least 4, and $R_1$ and $R_2$ are any chemically stable groups which stabilize the polymer against rapid depolymerization in alkaline solution. Preferably the polyacetal carboxylate will be one wherein M is alkali metal, e.g., sodium, n is from 20 to 200, $R_1$ is

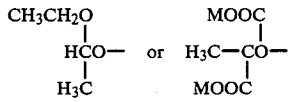

or a mixture thereof, $R_2$ is

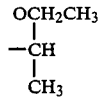

and n averages from 20 to 100, more preferably 30 to 80. The calculated weight average molecular weights of the polymers will normally be within the range of 2,000 to 20,000, preferably 3,500 to 10,000 and more preferably 5,000 to 9,000, e.g., about 8,000.

Although the preferred polyacetal carboxylates have been described it is to be understood, they may be wholly or partially replaced by other such polyacetal carboxylates or related organic builder salts described in various Monsanto patents on such compounds, processes for the manufacture thereof and compositions in which they are employed. Also, the chain terminating groups described in the Monsanto patents referred to, especially U.S. Pat. No. 4,144,226, may be utilized, providing that they have the desired stabilizing properties, which allow the mentioned builders to be depolymerized in acidic media, facilitating biodegradation thereof in waste streams, but maintain their stability in alkaline media, such as washing solutions.

When it is desired to avoid the presence of phosphorus in the detergent composition polyphosphate builders may be omitted from the present formulations, in which case it is preferred to employ other non-phosphate builders, such as those mentioned herein. Combinations of zeolite and polyacetal carboxylate are very useful substitutes for the polyphosphate builders, and such combinations, with N-alkyl isostearamides in detergent compositions (but without bentonite), are described in Ser. No. 677,147, for Antistatic Built Synthetic Organic Detergent Composition, filed by Gary M. Freeman on Dec. 3, 1984. The sodium salts of such builders are preferably employed but alkali metal and other soluble salts may be at least partially substituted for them.

Electrolytes and fillers may be present in the liquid detergent, such as sodium sulfate (preferred) and sodium chloride, to modify its physical characteristics and to add electrolyte to the product and to the wash water when such is considered to be desirable, and they may also serve other functional purposes.

The antistatic agent of choice in the practice of the present invention is N-cocoisostearamide. Such antistatic agent is an amide which is chemically derivable from isostearic acid and cocoamine by the condensation reaction shown below:

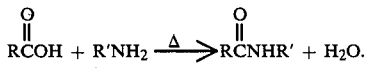

Isostearic acid,

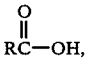

is a saturated fatty acid of the formula $C_{17}H_{35}COOH$, which is a complex mixture of isomers, primarily of the methyl-branched series, that are mutually soluble and virtually inseparable. While such acid normally has uses similar to those of stearic or oleic acids, it is considered that it is far superior to such materials in manufacturing effective antistatic agents, which are most suitable for incorporation in applicant's synthetic organic anionic liquid detergent compositions. Cocoamine is an aliphatic amine in which the aliphatic group is derived from coconut oil. Other primary aliphatic amines, preferably higher alkylamines of 7 to 18 carbon atoms in the alkyl, such as $R'NH_2$, wherein R' is such a higher alkyl, may also be used, but cocoamine produces N-alkyl isostearamide of the best properties for incorporation in detergent compositions. Such amine is named CISA.

While CISA is the most highly preferred antistatic agent (such may be referred to as antistats) it is within the broader aspects of this invention to employ other N-aliphatic isostearamides, such as those derived from primary aliphatic amines containing up to 20 carbon atoms, preferably 7–18 carbon atoms, the aliphatic parts of which may or may not be hydrogenated, provided that the amides made have sufficient antistatic effect in the described use. Some examples thereof are the N-alkylisostearamides of 7 to 18 carbon atoms, such as N-decylamine, N-octylamine and those derived from N-tallow-amine. However, it is considered that CISA is the best of the N-alkylisostearamides in antistatic activity and therefore when the other isostearamides are used, such use will preferably be with CISA, and the proportion of other isostearamide(s) will preferably be minor, with respect to the CISA. In some cases the hydrogen atom on the amide nitrogen may be replaced by suitable radicals, such as lower alkyl, e.g., methyl, providing that a desired antistatic effect is still obtained, but it has been found that the tertiary isostearamides usually are of little antistatic activity.

The bentonite utilized is preferably a Wyoming or western bentonite having a swelling capacity in the range of 3 to 15 ml./gram, preferably 7 to 15 ml./g., and its viscosity, at a 6% concentration in water, will usually be in the range of 3 to 30 centipoises, preferably 8 to 30 centipoises. Useful swelling bentonites of this type are sold under the trademark Mineral Colloid, as industrial bentonites, by Benton Clay Company, an affiliate of Georgia Kaolin Co. Such materials were formerly marketed under the trademark THIXO-JEL by such company. They are selectively mined and beneficiated bentonites, and those considered to be most useful are available as Mineral Colloid 101, etc., and correspond to those formerly sold as THIXO-JEL's No's. 1, 2, 3 and 4. These materials have pH's (6% concentration in water) in the range of 8 to 9.4, maximum free moisture contents of about 8% and specific gravities of about 2.6, and for the pulverized grade about 85% passes through a 200 mesh U.S. Sieve Series sieve. Equivalent to such bentonite is that sold as Bentonite Clay AEG 325 by American Colloid Co., which is essentially of No. 325 sieve size (U.S. Sieve Series).

Beneficiated Wyoming bentonite is preferred as a component of the present compositions but other bentonites are also useful, especially when they form only a minor proportion of the bentonite used. It has been found that at least about 2%, preferably at least 4%, and more preferably 5% or more, to about 8%, of water should be present in the bentonite initially, before it is admixed with other bead components and with the liquid medium for the liquid detergent. It has been established that overdrying to the point where the bentonite loses its "internal" moisture can interfere with the ability of the bentonite to hydrate effectively in aqueous medium, and can significantly diminish the fabric softening utility of the present compositions.

Among the various adjuvants that may be present in present liquid detergents are colorants, such as dyes and pigments, perfumes, enzymes, stabilizers, thickeners, solvents, dispersants, activators, fluorescent brighteners, bleaches, buffers, fungicides, germicides, foaming agents, antifoams and flow promoting agents. Also included among adjuvants, builders and fillers, unless in other classes that are mentioned, are various additional components or impurities sometimes present in the components of the compositions. For example, it is known that sodium carbonate and water are often present with polyacetal carboxylate in Builder U, a product which is a present source of polyacetal carboxylate.

Proportions of the essential components of the detergent compositions are such as to make them operative for the intended purposes of the compositions. Thus, the synthetic organic detergent or mixture thereof will be present in the liquid detergent in a detersive proportion, the bentonite will be present in a fabric softening proportion and the higher aliphatic isostearamide antistat will be present in an antistatic proportion. When the builder or builder mixture is present, as it is in most detergent compositions of this invention, it will be present in a detergent building proportion. The proportions described will normally be 3.5 to 25% of the liquid detergent, preferably 3 to 15% of sodium linear higher alkylbenzene sulfonate and more preferably about 5 to 13% thereof, e.g., about 9% of sodium linear alkylbenzene sulfonate of 12 to 13 or 14 carbon atoms, with 0.5 to 10% of sodium higher fatty alcohol polyethoxy ether sulfate of 8 to 18 carbon atoms in the alcohol and 1 to 15 moles of ethylene oxide per mole, preferably 1 to 5% of sodium higher primary alcohol polyethoxy ether sulfate of 12 to 15 carbon atoms in the alcohol and of 2 to 4 or 6 moles of ethylene oxide per mole, e.g., about 2%. The builder for the liquid detergent, which may be a mixture of builders, will normally be 5 to 40% of the composition, often preferably being a combination of 5 to 25% of sodium tripolyphosphate and 2 to 10% of sodium carbonate and more preferably often being a combination of 8 to 14% of sodium tripolyphosphate and 3 to 7% of sodium carbonate, e.g., about 11% and 4% respectively. The bentonite component will normally be 3 to 20% of the liquid detergent composition, preferably being 5 to 20% thereof and more preferably being about 5 to 15% thereof, about 12%, with the isostearamide antistat normally being 1 to 10% of the liquid detergent composition, preferably being 1 to 7% thereof and more preferably being about 3 to 7% thereof, e.g., about 5%. The water or aqueous medium content of the liquid detergent will usually be in the range of 3 to 80%, preferably from 40 to 70%, more preferably being about 45 to 65%, e.g., about 55%.

In the liquid detergent composition the ratio of bentonite to antistat will usually be in the range of one part of antistat to from 1 to 20 parts of bentonite, preferably being in the range of 1:1.5 to 4 and more preferably being in the 1:2 to 3 range, e.g., 1:2.4.

In making the invented liquid detergent compositions the various components of the final product are normally merely mixed or blended together and stirred or otherwise agitated sufficiently so as to produce a uniform liquid product. Orders of addition of components may be regulated so as to promote best mixing. Sufficient liquid medium will normally be present at all times so as to prevent caking of the solids with a deficient proportion of liquid, and to prevent the creation of lumps which might subsequently be difficult to disperse. Usually finely divided particulate components, both soluble and insoluble, will be admixed with a portion of the aqueous medium, and subsequently the balance of the aqueous medium will be utilized to thin the mix, in accordance with normal manufacturing techniques. The mix may be subjected to passage through a homogenizer so as to promote dispersions of the components and to prevent settling out thereof and in some instances hydrotropic materials, such as sodium cumene sulfonate and sodium xylene sulfonate, normally in small proportions, e.g., up to about 1 or 2%, may be present in the formula to help to maintain the liquid composition homogeneous. Similarly, solvents, such as ethanol and ethylene glycol or other suitable glycols may be employed to solubilize composition components, and such solvents also help to prevent freezing of the product when it is subjected to cold weather conditions. The various solid components of the liquid detergent composition that are employed will normally be in finely divided particulate state, so as to promote ready solution (when soluble) or dispersion in the aqueous medium. Usually the powdered materials will be of particle sizes less than No. 140 or No. 200, U.S. Sieve Series, and normally such particle sizes will be mostly within the range of No.'s. 140 to 400, often preferably 200 to 400, e.g., about No. 325. With readily soluble components, such as sodium carbonate, sodium tripolyphosphate and the synthetic organic detergents, the particle sizes may be at the larger ends of the given ranges, or even larger, but for insoluble or slowly soluble materials, such as zeolites and clays, the smaller particle sizes are generally more desirable.

In the use of the present invention, laundry is washed with a described liquid detergent composition in wash water, and such laundering is easily effected in accordance with normal laundry procedures, with standard equipment and normal washing concentrations of the invented liquid detergent compositions, and the washing results in a clean wash which is soft to the touch and does not exhibit objectionable static cling, even when substantial proportions of synthetics, such as polyesters, e.g., Dacron®, and polyamides, e.g., nylons, are present. The wash water employed may be any normal city water and the present liquid detergent compositions are effective even when the hardness is as high as 300 p.p.m., as calcium carbonate, and sometimes even higher. Normally the water hardness is of mixed magnesium and calcium ions hardness, usually with the major proportion being from calcium. Preferably the wash water will be of a hardness no greater than 250 p.p.m. and usually city waters employed will have hardnesses from 20 to 150 or 200 p.p.m., e.g., about 50 or 100 p.p.m. The present compositions may be used with wash waters at any of various temperatures (10° to 90° C.), and are effective even with wash waters at lower temperatures, such as about room temperature. Following European practice, the compositions may be used in wash waters at temperatures which may approach boiling, e.g., 70° to 90° C., but in usual American practice lower temperatures are utilized. Especially good results are obtained, in American washing practice, by employing the present compositions in wash waters at temperatures in the range of 10° to 50° C., preferably 30° to 50° C., e.g., about 40° C. The concentration of the liquid detergent composition in the wash water may be varied, depending on circumstances, but normally will be in the range of 0.1 to 0.5% by weight, preferably 0.1 to 0.4% and more preferably 0.15 to 0.25%, e.g., about 0.2%. Thus, one-half cup or 145 g. of the liquid detergent, often of a density of about 1.1 to 1.3 g./ml., e.g., about 1.2 g./ml., may be employed in a washing machine containing about 65 liters of water, to wash normal load, which is about 2.7 to 4.5 kg., e.g., about 3.6 kg., of dry laundry. In some instances, as when it is desired that the liquid detergent be such that greater or lesser volumes will be employed per wash load, the concentrations of the components in the liquid composition can be increased or decreased accordingly, within practical limits.

Standard home laundry washing machines and the normal wash cycles of such machines may be used, or industrial r commercial washing machines may be employed. Washing of the laundry is effected in a normal cycle over a period of about 2 to30 minutes, such as 5 to 20 minutes, e.g., about 10 minutes, usually depending on the dirtiness of the laundry and the nature of the fabric. After completion of the washing cycle the laundry is automatically rinsed, and is subsequently dried in an automatic laundry dryer, in which it is tumbled while being subjected to the passage of drying air through it.

Instead of a liquid detergent which includes all of the described detersive, building, fabric softening and antistatic components of the invented composition, in a variation of the present invention a liquid composition may be made comprising fabric softening and antistatic components, and such composition may be utilized in conjunction with a suitable liquid detergent, such as any of many such products on the market, to impart fabric softening and antistatic properties to laundry washed with such detergent. Thus, CISA or other suitable N-primary aliphatic isostearamide and bentonite (or other suitable fabric softening clay) may be emulsified, dispersed, suspended and/or partially dissolved in a suitable liquid medium, preferably aqueous, with a minor proportion of hydrotrope, emulsifying agent, suspending agent and/or solvent to produce a suitable pourable liquid preparation which can be employed in supplementation of the liquid detergent. Such liquid preparation can be added to the liquid detergent beforehand and/or may be added to the washing medium together with the liquid detergent, or it may be added to compositions of this invention or to the wash water with such compositions so as further to improve softness and antistatic properties of washed laundry. Utilizing the fabric softening and antistatic supplemental composition one is able to adapt the present invention to employment with any of various liquid detergent formulations. Thus, it is left to the consumer to determine, within reason, how much softening and antistatic effects are to be imparted to the laundry and it is possible to employ more of the supplement when utilizing detergent compositions which are especially effective (or harsh) detergents, requiring greater softening and more antistat treatment. Normally, in the supplementing liquid compositions described the proportion of combined fabric softener and antistat present will be from 10 to 30%, but from 10 to 50% is feasible, especially if a co-solvent, such as ethanol, is present. The proportion of antistat to bentonite will be in the same range(s) as previously given for the described liquid detergent compositions containing both antistat and softener Various advantages of the invention, some of which were previously alluded to, will be clearly illustrated in the working examples, which follow. The N-primary aliphatic isostearamide antistat does not react objectionably with bentonite nor does it so react with the anionic detergents, and therefore, compositions of this invention are comparatively stable on storage and do not lose significant proportions of their desired detersive, softening and antistat activities on storage or before or in use. Unlike compositions based on the usual currently employed cationic fabric softeners and antistatic agents, such as quaternary ammonium salts, the present compositions o not deposit reaction products of such cationic materials and anionic detergents onto laundry being washed, so such laundry is not as subject to soil deposition during washing processes when the present invention is employed. The invented detergent compositions produce whiter laundry and less soil redeposition too, whereas laundry washed with compositions containing anionic detergent and quaternary ammonium salt (in antistat and fabric softener proportions) tend to become yellower, especially on repeated washings. Detergency is measurably better when the present compositions are employed than when those are used in which a quaternary ammonium salt is present instead of the isostearamide. Also, interference with the foaming power of the anionic detergent, usually noted when cationics, such as quaternary ammonium salts, are present, and reactions of such "quats" with fluorescent brighteners, and resulting diminished brightening of laundry, are avoided when the present antistats are used. Such undesirable interactions of anionic and cationic materials are especially serious and objectionable when both the anionic detergents and the cationic softener-antistats are present for comparatively long periods of time in intimate contact, as they are when they are in the same aqueous medium, such as in some fabric softening anionic liquid detergents. It is evident that the present invention represents a significant improvement in the detergent art, wherein today it is important that detergent compositions possess fabric softening and antistatic properties, in addition to excellent detergency.

The liquid detergents of this invention and the liquid supplements described above are both preferably sufficiently viscous or (thixotropic) as to maintain finely divided particulate components in suspension and to prevent settling out thereof on storage, and yet the liquids should be freely flowable through a relatively narrow necked bottle dispensing opening. It has been found that liquids of viscosities within the range of 1,000 to 5,000 centipoises usually do not settle out and they possess the desired flow characteristics Accordingly, the present liquids will desirably be of a viscosity in such range. More preferably, such range may be from 3,000 to 5,000 cps., e.g., about 4,000 cps., at room temperature (25° C.). While it is considered that the viscosities of the present compositions are comparatively stable it is recognized that relatively small changes in plant manufacturing processes and changes in storage conditions may influence the viscosity of the product, which more frequently increases, rather than decreases on storage. If the viscosity or thickness increases excessively it will usually be found that placement of a case of packed bottles in a shaking machine will almost always make the composition flowable from the bottle and will disperse any components which may have separated out.

The following examples illustrate but do not limit the invention. Unless otherwise indicated, all parts are by weight and all temperatures are in ° C. in the examples, in the specification, and in the appended claims.

EXAMPLE 1

| Component | Percent |
|---|---|
| Sodium linear tridecylbenzene sulfonate | 9.0 |
| Sodium primary higher alcohol ether sulfate* | 2.0 |
| Bentonite (American Colloid Company AEG 325) | 12.0 |
| Sodium tripolyphosphate | 11.0 |
| Sodium carbonate | 4.0 |
| N—cocoalkyl isostearamide | 5.0 |
| Optical brightener (Tinopal LMS X [CIBA GEIGY]) | 0.3 |
| Sodium carboxymethyl cellulose | 0.2 |
| Titanium dioxide | 0.5 |
| Coloring pigment (ultramine blue) | 0.2 |
| Dye (Polar Brilliant Blue, 1% aqueous solution) | 0.6 |
| Perfume | 0.5 |
| Deionized water | 54.7 |
| | 100.0 |

*Reaction product of primary alcohol of 12 to 15 carbon atoms and 3 moles of ethylene oxide per mole.

The detergent components are dissolved in ⅔ of the water, after which the CISA is dispersed and dissolved in the detergent solution thus made, and the builder salts are dissolved in such aqueous medium, after which the bentonite in finely divided particulate form is dispersed in the composition, followed by additions of the various adjuvants and the balance of the water. The product resulting is of a viscosity about 3,000 centipoises at 25° C., using a Brookfield viscometer with a No. 3 spindle at a speed of 12 r.p.m. The detergent composition is stable, with the components thereof remaining dissolved-dispersed in the aqueous medium and not settling out or otherwise separating.

A mixed fabric load of 3.6 kg. of laundry made from various materials (polyester, nylon, acetate and polyester-cotton blend) is washed in a conventional G.E. top loading washing machine, containing 65 liters of water of 100 p.p.m., as calcium carbonate, of mixed calcium and magnesium ions hardness, using 145 grams of the liquid detergent composition of the above formula, and the washed laundry, including test swatches of the different materials mentioned, is rinsed and subsequently is dried in a automatic laundry dryer of the tumble drying type. The softness of the various fabrics is evaluated by expert evaluators and the protection of each of the fabrics against electrostatic charge (and objectionable static cling) generation on tumble drying and during other motion is also evaluated, by noting the extent of static cling exhibited by the individual laundry items. The washed laundry is satisfactorily soft and non-clinging.

Quantitative measurements of the electrostatic charge pick-ups by the different washed and dried fabrics are obtained by rubbing each of the fabrics with wool in a controlled manner at a low relative humidity (25 to 30% R.H.) and measuring the charges accumulated by the swatches. In this test a plurality of swatches is employed and average readings for each material are computed. To obtain an antistat index, representing an overall evaluation of the antistat capability of a liquid detergent composition, it has been found useful to employ the sums of the charges on the mentioned materials. Thus, such sum for the present liquid detergent is 12 kilovolts whereas for a control liquid detergent of the same formula but omitting bentonite and CISA, the index is 48 kilovolts. For the present tests readings in excess of 35 kilovolts are usually unacceptable (the laundry will cling objectionably). When evaluated for softness (terrycloth towels are the laundered test items) by a panel of experienced evaluators for this property in laundry, the towels washed with the liquid detergent composition of this example according to the method described above are rated 9 for softness on a scale of 1–10, with 10 being the softest. Towels washed with the control composition in the same manner are rated 1.

In other tests made the extent of redeposition of soil on the washed laundry is found to be about the same with the invented product as with a second control product, which is like the given invented formula except for replacement of the N-alkyl isostearamide with water, and such redeposition is worse (more) for a third control detergent composition, like the invented composition except for replacement of the isostearamide with the same percentage of dimethyldistearyl ammonium chloride.

The test cloths and laundry washed with the invented product show no "quat-spotting", which sometimes is noted on laundry washed with similar formulas containing dimethyldistearyl ammonium chloride or other quaternary compound instead of the N-isostearamide antistat. Also, the optical brightening effect for the invented product containing N-isostearamide is greater than that for a similar product, in the formula of which the isostearamide is replaced by dimethyldistearyl ammonium chloride or other such antistatic quaternary ammonium halide. Another advantage of using CISA instead of the "quat" is an improvement in the appearance of the liquid detergent composition due to the absence of any precipitated product from reaction of the quat and the anionic detergent.

When, in the formula of the invented product given, the 5% of N-cocoalkyl isostearamide is replaced by 1%, 3% and 7%, respectively, of such isostearamide, the softness evaluations of the products resulting are 8, 8 and 9, respectively, and the static indices are 27, 19 and 10, respectively. Softness indices of 8 or above are considered satisfactory, as are static indices of less than 30, with softness indices as low as 7 and static indices as high as 35,sometimes being rated acceptable. When CISA is omitted from the formula, as in the second control, the washed laundry is given a softness rating of 8 and the electrostatic charge index is 36 kilovolts.

When in practical laundry tests the first control and the invented compositions are compared, it is found that the control does not satisfactorily soften laundry and produces high electrostatic charges and objectionable static cling. When bentonite is omitted from the invented composition formula, as in the fourth control, the detergent compositions are unsatisfactory with respect to both softening power and static cling inhibition, even when a comparatively high proportion of the isostearamide is present. When the isostearamide is omitted objectionable static cling of washed laundry is observed despite the presence of 12% of bentonite. Thus, it is seen that the combination of bentonite and N-higher alkyl isostearamide is important to the success of the present laundry detergent compositions because:

(1) such combination leads to obtaining greater antistatic action than would be predictable; (2) the bentonite softens laundry; and (3) both fabric softening and antistatic (anti-cling) properties are now required of detergent compositions by discriminating consumers.

Instead of the preferred N-cocoalkyl isostearamide other higher aliphatic isostearamides, preferably higher primary aliphatic isostearamides, and more preferably higher primary N-alkyl isostearamides, may be utilized, such as N-n-octyl isostearamide, N-n-decyl isostearamide, N-n-heptyl isostearamide, N-n-dodecyl isostearamide, N-n-tetradecyl isostearamide and N-primary hydrogenated tallow isostearamide.

When the bentonite content of the lead formula given is modified within the 3 to 20% range, as to 10%, 15% and 18%, useful softening and antistatic detergent compositions result, and even when the bentonite content is decreased to 5% noticeable fabric softening is obtainable. Similarly, changes in the proportion of anionic detergent may be made within the range of 3.5 to 25%, e.g., 5%, 15% and 25%, and the total proportion of builder salt may be varied within the 5 to 40% range, e.g., to 10, 20 and 30%, and effective softening and antistatic detergent compositions can result. In all such compositions water will constitute the balance, except for any adjuvant(s) present, which will usually be limited to no more than 10%.

The bentonite utilized may be changed to any of the other types of bentonite mentioned previously in the specification, and sometimes other useful swelling clays, such as other montmorillonites may be used, but usually it will be preferable to employ western or Wyoming type of bentonite. The sodium linear tridecylbenzene sulfonate may be replaced either in whole or in part by sodium linear dodecylbenzene sulfonate or other linear higher alkylbenzene sulfonate of 10 to 15 or 18 carbon atoms, or with other anionic detergent, such as sodium lauryl sulfate, sodium cetyl sulfate, sodium paraffin sulfonate, wherein the paraffin is of about 16 carbon atoms, and/or sodium cocomonoglyceride sulfate, or any of various mixtures thereof. The ether sulfate may be replaced with other similar detergent, such as sodium dodecyl pentaethoxy sulfate, or with other(s) of the anionic detergents previously mentioned. Other builders may be substituted for the polyphosphate and carbonate, such as those previously named, and non-phosphate detergents can thus be prepared.

In the described variations, within the invention, of the preferred lead formula the products obtained are useful fabric softening and antistatic detergent compositions and are superior, in the properties previously described, to formulations from which the bentonite and isostearamide have been omitted and from formulations in which quaternary ammonium salts are employed instead of the isostearamide.

EXAMPLE 2

Instead of making the complete fabric softening and antistatic liquid detergent composition described in the formula of Example 1, in a variation of the present invention a fabric softening and antistatic composition, which may be referred to, for convenience, as a "softstat", is made, comprising bentonite and N-primary higher aliphatic isostearamide (CISA), in a liquid, aqueous medium. Such a liquid composition is made by merely mixing 14.1 parts of American Colloid Company AEG 325 Bentonite and 5.9 parts of N-cocoalkyl isostearamide with 80 parts of deionized water (although city water may do if deionized water is not available). The Example 1 bentonite:isostearamide ratios may also be employed. Due to the thickening action of the swelling bentonite component the powdered N-isostearamide is held suspended in the aqueous medium and the softstat is ready for bottling, shipping, storage, sale and use without further formula modifications. However, a co-solvent, such as ethanol or hexylene glycol may be included to promote dissolving of the N-isostearamide (and to act as an anti-freeze), in which case a sufficient proportion of either or both of ethanol and hexylene glycol will be employed to promote solubility and prevent freezing. Also, about 1% of sodium xylene sulfonate as a hydrotrope, may be included in the formula, with or without 0.1 to 2% of sodium polyacrylate to dispense and/or suspend the bentonite in the aqueous system. Similarly, colorants, antioxidants, buffers, gums, antiredeposition agents (sodium carboxymethyl celluose), optical brighteners, and perfumes may be included in the formula, in normal adjuvant proportions, most of which will be under 2% and often under 1%.

The softstat made may be added by either the manufacturer or the consumer to another liquid detergent composition to improve the fabric softening antistatic properties of such composition. The proportion of the softstat being added to the liquid detergent will be such that the added material will exert fabric softening and antistat actions when the improved detergent composition is utilized. Because of the diluting effect of the softstat it will generally be desirable for more of the improved detergent composition to be used. Alternatively, the concentrations of active components in the softstat will be kept as high as reasonably possible to obtain optimum softening and antistat effects. Also, the liquid softstat may be added directly to the wash water in the washing machine, with the liquid detergent. By either of such methods of use any of various commercial built synthetic organic anionic liquid detergent compositions may be improved in fabric softening and antistatic effects. Also, it is contemplated as within the present invention to utilize the present liquid softstat as a means of adding softening and antistatic properties to laundry washed with any of various different synthetic detergent compositions, particulate as well as liquid, and nonionic or amphoteric, as well as anionic. In such aspect this invention is operative with all of the best known commercial built synthetic organic detergent products, and, as was previously indicated, such improvement is not at the expense of cleaning, brightening and other desirable properties of such detergent compositions.

EXAMPLE 3

A washing proportion of the composition of the lead formula of Example 1 is used to wash a standard load of laundry in a conventional General Electric top loading home laundry washing machine. Alternatively, a washing proportion (120 g.) of liquid detergent composition (like the first control, without bentonite and CISA) is added to the wash water, followed by separate additions of the formula proportions of 17.6 g. of bentonite and 7.4 g. of N-cocoalkyl isostearamide (which may be dispersed in, dissolved in or blended with a suitable liquid medium or particulate carrier, and preferably are in 125 g. of a softstat, as described in Example 2). The machine is filled with 65 liters of city water of a hardness of about 100 p.p.m., as calcium carbonate, of mixed magnesium and calcium hardness, with the calcium hardness being the major hardness. The wash water is at a temperature of 40° C. and the charge of dirty laundry to the wash water is about 3.6 kilograms. The laundry washed is made of cotton, mixed cotton-polyester, acetate and polyamide (nylon), and is soiled with normal soils. Washing is continued over a period of ten minutes, after which the laundry is automatically rinsed and spin dried. It is then dried in an automatic laundry dryer, in which it is tumbled while being subjected to the passage of hot drying air through it. After drying, the laundry is evaluated by a panel of trained evaluators and is found to be satisfactorily clean, soft to the touch and free of annoying static cling. When the control detergent composition, which does not contain bentonite or the N-substituted isostearamide in its formula, is similarly used (but alone) to wash similar laundry its cleaning power is satisfactory but the laundry is noticeably harsh in feel and is subject to static cling, with the static cling being especially noticeable for the laundry items which include synthetic polymer fibers in the fabrics thereof.

EXAMPLE 4

Instead of employing the composition of Example 2 to improve a liquid detergent composition and instead of adding it to the wash water, it may also be used as a rinse water softener and antistat In this embodiment of the invention the liquid softstat may be added to the rinse after washing the laundry with a conventional detergent composition. Normally the charge of the softstat will be that which is sufficient to impart to the washed laundry discernible antistatic and softening effects. For example, normally the charge to the rinse water will be from 0.05 to 0.5%, preferably 0.1 to 0.3%, e.g., 0.2%. In a typical example of this embodiment of the invention the laundry will be washed in the manner described in Example 1 with a detergent composition like that of that example except for the replacements of the bentonite and CISA with water (a small proportion of gum or other thickener may have been added to the liquid to adjust the viscosity, if desired, e.g. 0.1 to 1% of CMC, PVA (polyvinyl alcohol), PVP (polyvinyl pyrrolidone) or other gum known for this purpose. After washing of the laundry, which may be a normal charge of mixed cotton and synthetic polymeric fabrics laundry, the Example 2 softstat composition, containing 14.1 parts of bentonite and 5.9 parts of CISA in 80 parts of deionized water, is added to the rinse water in a 0.2% concentration (130 grams per 65 liters of the 100 p.p.m. hardness rinse water). The laundry is subsequently dried, sometimes after plural rinsings, and will be found to be of low static charge after machine drying, and will be softer than control laundry that is not subjected to the described rinse treatment.

The invention has been described with respect to various illustrations and embodiments thereof but is not to be considered as being limited to these because it is evident that one of skill in the art, with the present specification before him or her, will be able to utilize substitutes and equivalents without departing from the invention.

What is claimed is:

1. A fabric softening and antistatic liquid laundry detergent composition which comprises a detersive proportion a synthetic anionic organic detergent, a fabric softening proportion of bentonite and an antistatic proportion of N-higher aliphatic isostearamide antistat, in an aqueous medium.

2. A liquid detergent composition according to claim 1 which contains a detergent building proportion of a detergent builder and in which the detergent is of the sulfate and/or sulfonate type(s)

3. A liquid detergent composition according to claim 2 wherein the detergent builder is selected from the group consisting of polyphosphate, carbonate, bicarbonate, sesquicarbonate, silicate, zeolite, citrate, nitrilotriacetate and polyacetal carboxylate builders, and mixtures thereof.

4. A liquid detergent composition according to claim 3 which comprises about 3.5 to 25% of sulfate and/or sulfonate detergent, about 3 to 20% of bentonite, about 1 to 10% of isostearamide, about 5 to 40% of builder and about 30 to 80% of water.

5. A liquid detergent composition according to claim 4 which comprises 3 to 15% of sodium linear higher alkyl benzene sulfonate, 0.5 to 10% of sodium higher fatty alcohol polyethoxy ether sulfate in which the higher fatty alcohol moiety is of 8 to 18 carbon atoms and in which the polyethoxy ether moiety is of 3 to 30 moles of ethylene oxide per mole of such detergent, 3 to 20% of bentonite, 1 to 10% of N-higher aliphatic isostearamide in which the higher aliphatic group is a primary hydrocarbon chain containing 7 to 18 carbon atoms, 5 to 25% of sodium tripolyphosphate, 2 to 10% of sodium carbonate and 40 to 70% of water.

6. A liquid detergent composition according to claim 5 which comprises 5 to 13% of sodium linear higher alkylbenzene sulfonate wherein the higher alkyl is of 12 to 14 carbon atoms, 1 to 5% of sodium higher primary alcohol polyethoxy ether sulfate wherein the higher primary alcohol moiety is of 12 to 15 carbon atoms and the polyethoxy ether moiety is of 6 to 20 moles of ethylene oxide per mole of such detergent, 5 to 15% of bentonite, 1 to 7% of N-primary higher alkyl isostearamide wherein the higher alkyl is of 7 to 18 carbon atoms, 8 to 14% of sodium tripolyphosphate, 3 to 7% of sodium carbonate, 0.1 to 1% of sodium carboxymethyl cellulose and 45 to 65% of water.

7. A detergent composition according to claim 6 which comprises about 9% of sodium linear higher alkylbenzene sulfonate wherein the higher alkyl is of 12 to 13 carbon atoms, about 2% of sodium primary alcohol polyethoxy ether sulfate wherein the primary alcohol is of about 12 carbon atoms and the polyethoxy ether moiety is of about 15 moles of ethylene oxide per mole of such detergent, about 12% of bentonite, about 5% of N-cocoalkyl isostearamide, about 11% of sodium tripolyphosphate, about 4% of sodium carbonate, about 0.2% of sodium carboxymethyl cellulose, about 1.5% of adjuvants and about 55% of water.

8. A process for washing laundry and simultaneously softening it and lowering its capacity to generate and/or hold an electrostatic charge, which comprises washing the laundry in an aqueous medium containing a detersive proportion of a liquid laundry detergent composition according to claim 1, rinsing the laundry and drying it in an automatic laundry dryer.

9. A process according to claim 8 wherein the detergent composition is according to claim 4 and the concentration thereof in the wash water is in the range of 0.1 to 0.4%.

10. A process according to claim 9 wherein the detergent composition is according to claim 6, the water temperature is in the range of 10° to 90° C. and the water is of a hardness up to 300 p.p.m., as calcium carbonate.

11. A fabric softening and antistatic liquid laundry detergent composition which is of a viscosity in the range of 1,000 to 5,000 centipoises and which comprises a detersive proportion of a synthetic anionic detergent, a fabric softening and thickening proportion of bentonite, and an antistatic proportion of N-higher aliphatic isostearamide antistat, in an aqueous medium.

12. A liquid detergent composition according to claim 11 which is of a viscosity in the range of 3,000 to 5,000 centipoises at room temperature, which contains a detergent building proportion of a detergent builder, and in which the detergent is of the sulfate and/or sulfonate type(s).

* * * * *